US008778427B2

(12) United States Patent
Dal

(10) Patent No.: US 8,778,427 B2
(45) Date of Patent: Jul. 15, 2014

(54) PACKAGING, UNIT COMPRISING SUCH A PACKAGING AND A FOOD PRODUCT, AND SHEET FOR THE PRODUCTION OF SAID PACKAGING

(75) Inventor: Sylvain Dal, Marcilly en Beauce (FR)

(73) Assignee: Fromageries Bel, Paris (FR)

( * ) Notice: Subject to any disclaimer, the term of this patent is extended or adjusted under 35 U.S.C. 154(b) by 2723 days.

(21) Appl. No.: 10/554,644

(22) PCT Filed: Mar. 24, 2004

(86) PCT No.: PCT/FR2004/000733

§ 371 (c)(1),
(2), (4) Date: Oct. 27, 2005

(87) PCT Pub. No.: WO2004/099034

PCT Pub. Date: Nov. 18, 2004

(65) Prior Publication Data

US 2006/0275531 A1 Dec. 7, 2006

(30) Foreign Application Priority Data

Apr. 29, 2003 (FR) ..... 03 05270

(51) Int. Cl.
*B65D 75/00* (2006.01)
*B65D 75/02* (2006.01)

(52) U.S. Cl.
USPC ..... 426/130; 426/123

(58) Field of Classification Search
USPC ..... 426/130, 123; 229/87.05, 107; 206/551
See application file for complete search history.

(56) References Cited

U.S. PATENT DOCUMENTS

| | | | | |
|---|---|---|---|---|
| 1,483,443 | A * | 2/1924 | Hogan | 206/551 |
| 3,924,803 | A * | 12/1975 | de Habsburg | 229/87.05 |
| 4,801,075 | A * | 1/1989 | Weber et al. | 229/87.05 |

FOREIGN PATENT DOCUMENTS

| | | | | |
|---|---|---|---|---|
| DE | 32 33 670 | | 3/1984 | |
| DE | 3233670 | A * | 3/1984 | |
| DE | 3233670 | A1 * | 3/1984 | B65B 25/10 |
| EP | 0 803 439 | | 10/1997 | |
| EP | 803439 | A1 * | 10/1997 | |
| EP | 1 067 062 | | 1/2001 | |
| FR | 2 597 436 | | 10/1987 | |
| FR | 2 597 441 | | 10/1987 | |
| FR | 2597436 | A1 * | 10/1987 | |

OTHER PUBLICATIONS

Beolingus Online Dictionary, 'Schmelzkaese', www.dict.tu-chemnitz.de, accessed Dec. 22, 2008.*

* cited by examiner

*Primary Examiner* — Jyoti Chawla
(74) *Attorney, Agent, or Firm* — Young & Thompson

(57) ABSTRACT

A packaging includes a first sheet (1), in the form of a receptacle (2) and a second cover sheet (71), for covering the food product (70) and for sealing the receptacle (2). The first sheet (1) is made from a plastic material and the first ends (53*a*, 53*b*) of tear-off guide elements are spaced laterally with regard to each other and define a pull tab (58) in a flap (21). The above is of application for example in the cooking of fondue cheese.

20 Claims, 2 Drawing Sheets

Figure 1:
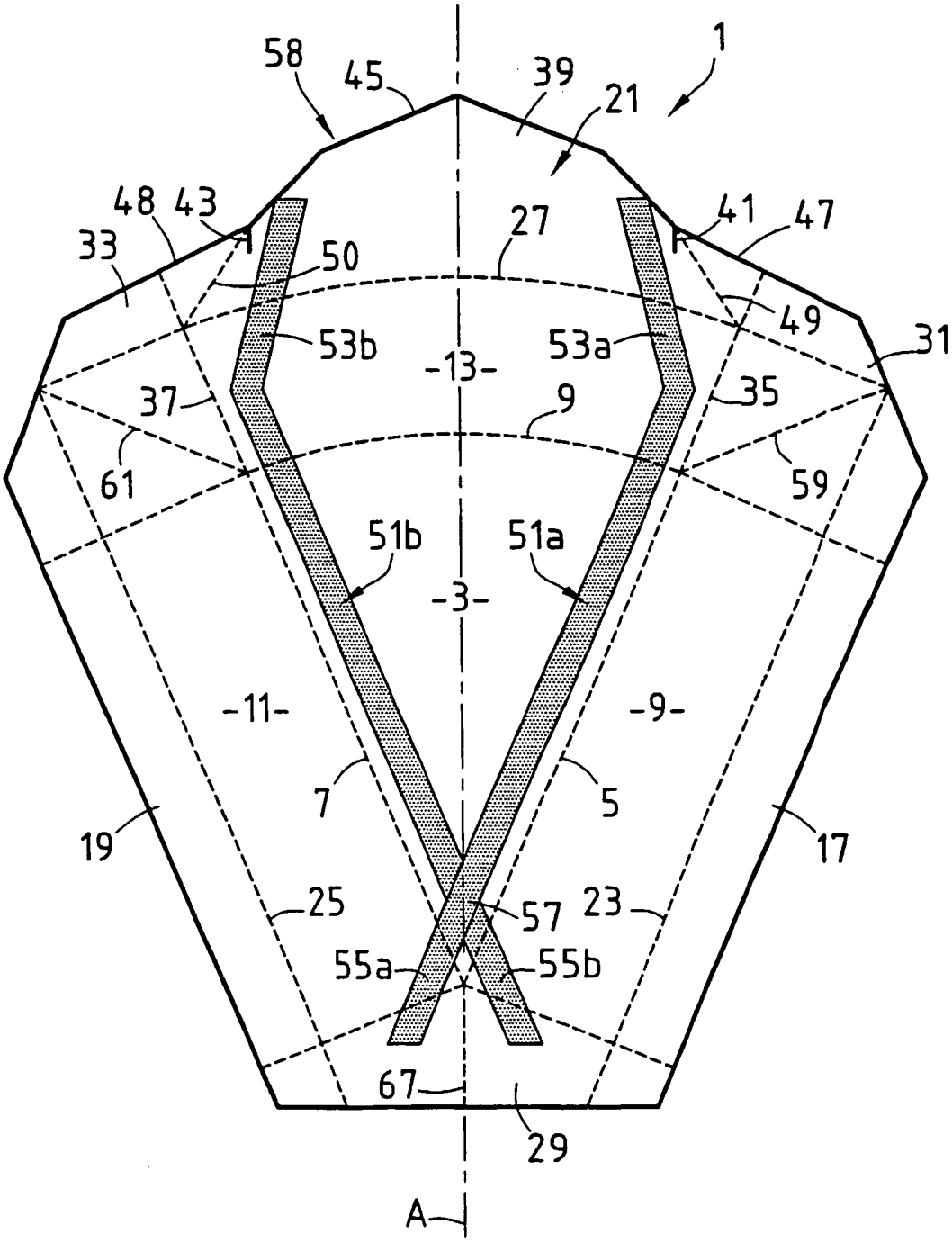

PACKAGING, UNIT COMPRISING SUCH A PACKAGING AND A FOOD PRODUCT, AND SHEET FOR THE PRODUCTION OF SAID PACKAGING

BACKGROUND OF THE INVENTION

1. Field of the Invention

The present invention relates to a packaging for the packing of a food product, of the type comprising:

- a first sheet shaped to form a receptacle for receiving the food product and comprising a base of substantially triangular shape bordered by two lateral walls, which meet at a point, and a wall forming a heel portion opposite the point, and
- a second sheet for covering the food product and sealing the receptacle, the first sheet comprising a pull tab for inducing tears, and tear guide means in order to allow the packaging to be opened, the guide means extending substantially along the lateral edges of the base into the wall forming the heel portion, first ends of the guide means extending into a flap which prolongs the heel portion and covers the second sheet.

The invention is applicable in particular to the packing of cheese spread.

2. Description of the Related Art

In the following, packagings having substantially triangular bases are understood as being packagings whose bases are effectively triangular with straight sides, but also packagings whose bases have a curved side and which therefore have the shape of a sector of a disc.

FR-2 597 436 describes a packaging of the type mentioned above for the packing of a cheese spread portion. That packaging is constituted by two aluminium sheets. The guide means are strips provided on the first sheet. The first ends of the tear guide strips overlap to form the gripping tab.

EP-803 439 has proposed replacing aluminium by polypropylene in packagings for the packing of cheese spread, in order to facilitate recycling. The packaging described in that document is constituted by three sheets, and opening is effected by tearing the lateral walls and the heel portion of the packaging.

Such a method of opening is not entirely satisfactory in so far as only the lateral walls and the heel portion are freed from the cheese spread portion. The consumer therefore has to touch the cheese in order to remove the cover or the base of the packaging before the product can be consumed.

The packaging structure and the method of opening described in FR-2 597 436 are more satisfactory for consumers. However, such a structure cannot be used with a material such as polypropylene, which is much stronger than aluminium.

Accordingly, the tear propagation as provided in FR-2 597 436 would not be able to occur in a sheet of polypropylene.

Furthermore, it is tricky to obtain a perfect overlap of the ends of the strips, as described in FR-2 597 436, and in practice a consumer frequently grasps only one of the strips. The consumer is then unable to open the entire packaging, parts of the cheese spread portion remaining in the packaging and the consumer then having to touch the cheese in order to remove it from the packaging completely.

SUMMARY OF THE INVENTION

An object of the invention is to resolve those problems by providing a packaging of the above-mentioned type which, while being more readily recyclable, can be opened in a simple and satisfactory manner in order to give access to the totality of the product packed in the packaging.

To that end, the invention relates to a packaging of the above-mentioned type, characterised in that at least the first sheet is made of plastics material, and in that the first ends of the guide means are spaced laterally from one another and delimit between them the pull tab in the flap.

According to particular embodiments, the packaging may have one or more of the following features, taken in isolation or in accordance with all the technically possible combinations:

- tear initiating means are provided laterally in an edge of the flap outside the pull tab;
- the guide means extend along the lateral edges of the heel portion;
- second ends of the guide means extend into a wing portion which prolongs the point and is turned down onto one of the lateral walls;
- the pull tab extends substantially over the entire width of the heel portion; and
- the guide means comprise strips provided on the first sheet.

The invention relates further to a unit comprising a packaging and a food product packed in the packaging, characterised in that the packaging is a packaging as defined above.

According to a variant, the food product is cheese spread.

The invention relates also to a sheet for the production of a packaging as defined above, characterised in that it comprises:

- a region that is to form a base of substantially triangular shape,
- two regions that are to form two lateral walls which meet along a point,
- a region that is to form a heel portion opposite the point,
- tear guide means, the guide means extending substantially along lateral edges of the region that is to form the base into the region that is to form the heel portion, the guide means comprising first ends which extend into a flap intended to prolong the heel portion, and the first sheet is made of plastics material, and the first ends of the guide means are spaced laterally from one another and delimit between them, in the flap, a pull tab for inducing tears in the packaging.

BRIEF DESCRIPTION OF THE DRAWING FIGURES

Figure 2:
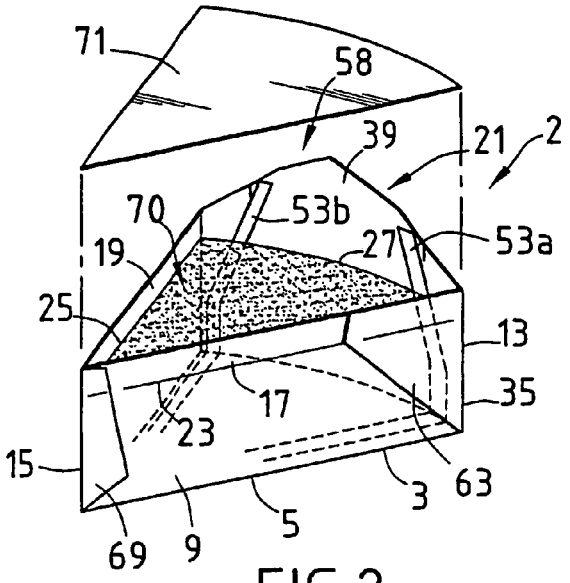
Figure 3:
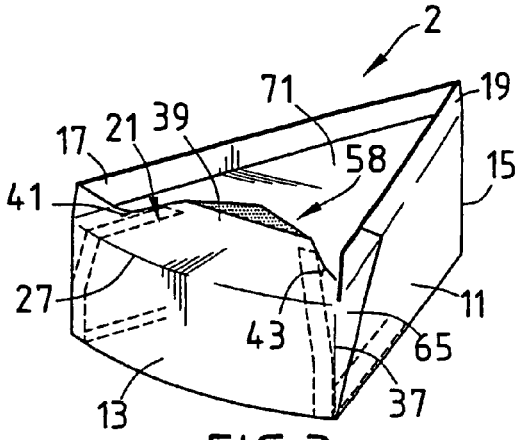
Figure 4:
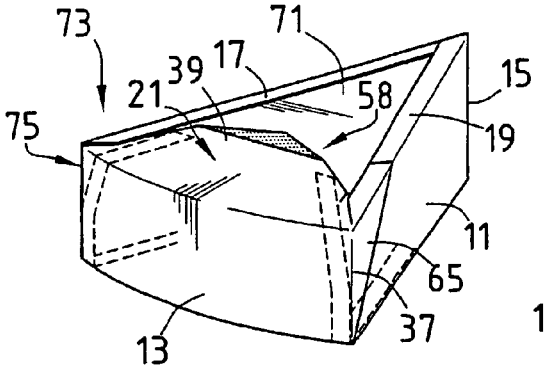
Figure 5:
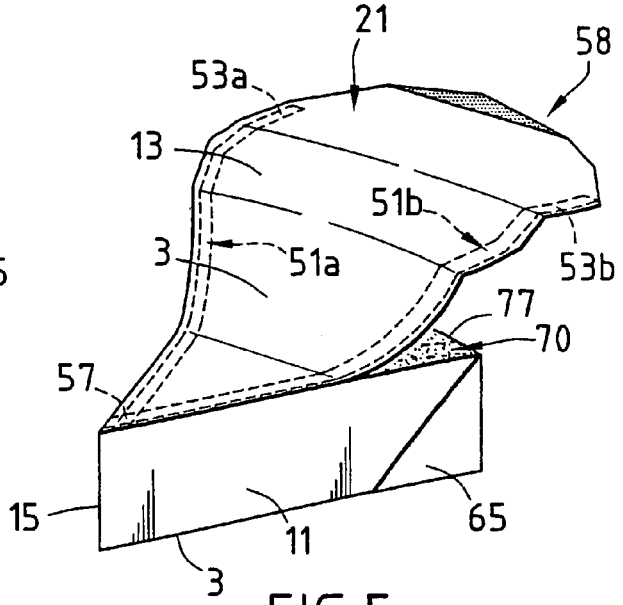
Figure 6:
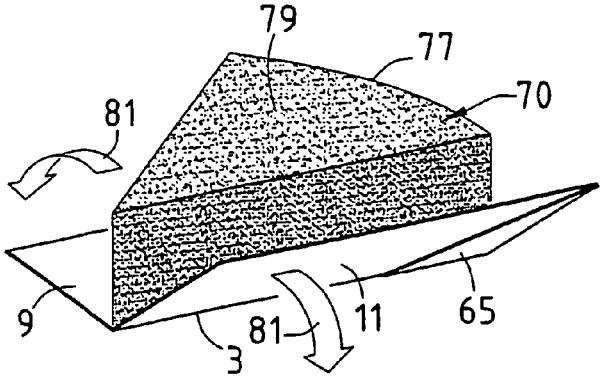

The invention will better be understood upon reading the following description, which is given solely by way of example and with reference to the accompanying drawings, in which:

FIG. 1 is a plan view, in diagrammatic form, of a first sheet of a packaging according to the invention, before folding, FIGS. 2 and 3 are perspective views, in diagrammatic form, showing two successive steps of the production of the packaging starting from the sheet of FIG. 1, FIG. 4 is a perspective view, in diagrammatic form, of the finished packaging, FIGS. 5 and 6 are views, in diagrammatic form, showing two successive steps of the opening of the packaging of FIG. 4.

DETAILED DESCRIPTION OF THE INVENTION

The sheet 1 shown in FIG. 1 is a sheet of polypropylene for packing a portion of cheese spread, having a base having the shape of a sector of a disc.

In order to form a packaging, and as shown in FIG. 2, the sheet 1 is shaped to form a receptacle 2 by folding along the dotted lines shown in FIG. 1.

The receptacle 2 has a base 3 which has the shape of a sector of a disc delimited by two lateral edges 5 and 7 and an arc-shaped edge 9. Perpendicularly to the plane of the base 3, the receptacle 2 has two lateral walls 9 and 11 which extend along the straight edges 5 and 7, and a curved wall forming a heel portion 13, which extends along the arc-shaped edge 9. The lateral walls 9 and 11 meet along a point 15 opposite the heel portion 13.

The lateral walls 9 and 11 and the heel portion 13 are prolonged by flaps 17, 19 and 21, respectively, which are to be turned down along fold lines 23, 25 and 27 when the packaging is sealed.

Before folding, the sheet 1 further comprises intermediate regions 29, 31 and 33 which are disposed, respectively, between the walls 9 and 11 and their flaps 17 and 19, between the wall 9 and the heel portion 13 and their flaps 17 and 21, and between the heel portion 13 and the wall 11 and their flaps 21 and 19. The lateral edges 35 and 37 of the heel portion 13 and of the flap 21 prolong the lateral edges 5 and 7 of the base 3. The flap 21 has a projecting central point 39 opposite the intermediate region 29.

As shown in FIG. 1, two cuts 41 and 43 are made in the sheet 1 between the outside edge 45 of the point 39 and the outside edges 47 and 48 of the remainder of the flap 21. Fold lines 49 and 50 extend from the cuts 41 and 43 to the points of intersection between the curved fold line 27 and the lateral edges 35 and 37 of the heel portion 13. Before the sheet 1 is folded, the fold lines 49 and 50 are inclined relative to the lateral edges 35 and 37.

The sheet 1 is also provided, on the side that is to form the inside face of the receptacle 2, with two tear guide strips 51*a* and 51*b*. The two strips 51*a* and 51*b* are substantially symmetrical relative to a median axis A of the sheet 1. The strips 51*a* and 51*b* have been fused by means of heat both to one another and to the sheet 1. The strips 51*a* and 51*b* are made of polypropylene, for example.

As shown in FIG. 1, each of the strips 51*a*, 51*b* has a first straight end 53*a*, 53*b* which extends from the point 39 into the flap 21 and into the heel portion 13, as far as the lateral edge 35, 37. The strips 51*a*, 51*b* then extend rectilinearly along the lateral edges 5 and 7 and terminate at second ends 55*a* and 55*b*, beyond a point of intersection 57. The ends 55*a* and 55*b* extend into the lateral walls 9 and 11 and into the intermediate region 29.

The first ends 53*a* and 53*b* are disposed close to the cuts 41 and 43, respectively, and are spaced laterally from one another.

Before the sheet 1 is folded, the ends 53*a* and 53*b* converge towards one another opposite the point of intersection 57 and delimit between them, in the flap 21, a pull tab 58 which comprises the point 39 and extends substantially over the entire width of the flap 21. After the first ends 53*a* and 53*b*, the two strips 51*a* and 51*b* converge towards one another as far as the point of intersection 57, before diverging again.

In order to obtain the receptacle 2 of FIG. 2 starting from the sheet 1, the intermediate regions 31 and 33 connecting the lateral walls 9 and 11 and the heel portion 13 are folded, starting from the base 3, in their middle, along lines 59 and 61, which are shown in FIG. 1. The triangular wing portions 63 and 65 so formed are folded back onto the lateral walls 9 and 11, respectively, along the lateral edges 35 and 37 of the heel portion 13. As regards the intermediate region 29 comprising the end of the strips 51*a* and 51*b*, it is likewise folded, in the middle, along a fold line 67 (FIG. 1), and the triangular wing portion 69 so formed is folded back onto the lateral wall 9. The second ends 55*a* and 55*b* of the strips 51*a* and 51*b* extend into the wing portion 69.

These different folding operations are, for example, carried out while hot, as described in EP-803 439, in order to obtain plastic deformation of the polypropylene of the sheet 1. This folding while hot can be carried out, for example, in a folding chamber into which the sheet 1 is pushed. It is likewise possible to produce some or all of the fold lines beforehand by mechanical deformation of the sheet 1, for example by means of a cutting wheel.

A given amount of cheese spread is poured, while hot, into the receptacle 2 so obtained, to a height equal to the height of the lateral walls 9 and 11 and of the heel portion 13, in order to constitute a portion 70, shown in FIG. 2.

A second sheet 71, having dimensions corresponding to those of the base 3, is placed on the portion 70. The second sheet 71 forms a sealing cover for the receptacle 2. It is, for example, also made of polypropylene. Then, as shown in FIG. 3, the flap 21 is turned down onto the sheet 71 and sealed thereto on either side of the cuts 41 and 43, leaving the point 58 free.

The flaps 17 and 19 are then turned down and sealed to the second sheet 71, as shown in FIG. 4.

In this manner there is obtained a unit 73 comprising a packaging 75, composed of the sheets 1 and 71, and the cheese spread portion 70 packed in the packaging 75.

The packaging 75 is opened in the manner shown in FIGS. 5 and 6. The consumer holds the two lateral walls 9 and 11 with the thumb and index finger of one hand and grasps the pull tab 58 with the other hand. By pulling on the tab 58 in a single movement, tears are initiated in the region of the cuts 41 and 43. As pulling is continued, the tears propagate along the strips 51*a* and 51*b* which guide them. The consumer can accordingly free the whole of the heel portion 77 from the portion 70, then the large triangular face 79 (FIG. 6) until the second ends 55*a* and 55*b* of the strips 51*a* and 51*b* cause tearing along the point 15, thus freeing completely the lateral walls 9 and 11, which then simply have to be turned down as indicated by the arrows 81 in FIG. 6.

The packaging 75 can therefore be opened to give access to the totality of the portion 70 without its being necessary to touch the portion 70. Furthermore, the rigidity of the material used to constitute the sheet 1 allows the strips 51*a* and 51*b* to be spaced from one another, while permitting satisfactory opening. The consumer therefore has the benefit of a large gripping tab 58 and there is no risk, as with the packaging of FR-2 597 436, that he will use only one of the two tear guide strips.

Furthermore, the guide path of the tears does not exhibit any pronounced change in direction as in FR-2 597 436. Accordingly, despite the strength of the material used to constitute the sheet 1, the tears initiated by the cuts 41 and 43 propagate in a satisfactory manner.

It will also be noted that the width of the pull tab 58 and the chosen method of opening result in rational opening which can be carried out by virtually all consumers.

Furthermore, because the tears are guided by strips 51*a* and 51*b* of small width, the overall cost of the packaging 75 remains low and the packaging has good tightness.

It will be noted that the above principles can be used with the sheet 1 and/or the sheet 71 produced of plastics materials other than polypropylene.

Moreover, the strips 51*a* and 51*b* can be replaced by guide means of other types.

Accordingly, such means may be local weakened areas in the first sheet 1, obtained, for example, by means of a cutting wheel or a laser beam.

The invention claimed is:

1. A packaging for packing of a food product, comprising:

a first sheet shaped to form a receptacle for receiving the food product and comprising a base of substantially triangular shape bordered by two lateral walls, which meet at a point, and a wall forming a heel portion opposite the point, and a second sheet for covering the food product and sealing the receptacle, the first sheet comprising a pull tab for inducing tears, and tear guide strips in order to allow the packaging to be opened, the tear guide strips extending substantially along lateral edges of the base into the wall forming the heel portion, first ends of the guide strips extending into a flap which prolongs the heel portion and covers the second sheet, wherein at least the first sheet is made of plastics material, and in that the first ends of the tear guide strips are spaced laterally from one another and delimit between them a pull tab in the flap.

2. The packaging according to claim 1, wherein tear initiating means are formed laterally in an edge of the flap outside the pull tab.

3. The packaging according to claim 1, wherein the tear guide strips extend along the lateral edges of the heel portion.

4. The packaging according to claim 3, wherein second ends of the tear guide strips extend into a wing portion which prolongs the point and is turned down onto one of the lateral walls.

5. The packaging according to claim 1, wherein the pull tab extends substantially over an entire width of the heel portion.

6. The packaging according to claim 1, wherein the tear guide strips are provided on the first sheet.

7. A unit comprising a packaging and a food product packed in the packaging, wherein the packaging is a packaging according to claim 1.

8. The unit according to claim 7, wherein the food product is cheese spread.

9. A sheet for the production of a packaging according to claim 1, comprising:

a region that is to form the base of substantially triangular shape, two regions that are to form the two lateral walls which meet along the point, a region that is to form the heel portion opposite the point, the tear guide strips, the tear guide strips extending substantially along the lateral edges of the region that is to form the base as far as the region that is to form the heel portion, the tear guide strips comprising the first ends which extend into a flap that is to prolong the heel portion, and the first sheet is made of plastics material, and the first ends of the tear guide strips are spaced laterally from one another and delimit between them, in the flap, the pull tab for inducing tears in the packaging.

10. The packaging according to claim 2, wherein the tear guide strips extend along the lateral edges of the heel portion.

11. A packaging for packing of a food product, comprising:

a first sheet shaped to form a receptacle for receiving the food product and comprising a base of substantially triangular shape bordered by two lateral walls, which meet at a point, and a wall forming a heel portion opposite the point, and a second sheet for covering the food product and sealing the receptacle, the first sheet comprising a pull tab for inducing tears, and tear guide strips in order to allow the packaging to be opened, the tear guide strips extending substantially along lateral edges of the base into the wall forming the heel portion, first ends of the tear guide strips extending into a flap which prolongs the heel portion and covers the second sheet, wherein at least the first sheet is made of plastics material, and in that the first ends of the tear guide strips are spaced laterally from one another and delimit between them a pull tab in the flap.

12. The packaging according to claim 11, wherein a tear initiator is formed laterally in an edge of the flap outside the pull tab.

13. The packaging according to claim 11, wherein the tear guide strips extend along the lateral edges of the heel portion.

14. The packaging according to claim 13, wherein second ends of the tear guide strips extend into a wing portion which prolongs the point and is turned down onto one of the lateral walls.

15. The packaging according to claim 11, wherein the pull tab extends substantially over an entire width of the heel portion.

16. The packaging according to claim 11, wherein the tear guide strips are provided on the first sheet.

17. A unit comprising a packaging and a food product packed in the packaging, wherein the packaging is a packaging according to claim 11.

18. The unit according to claim 17, wherein the food product is cheese spread.

19. A sheet for the production of a packaging according to claim 11, comprising:

a region that is to form the base of substantially triangular shape, two regions that are to form the two lateral walls which meet along the point, a region that is to form the heel portion opposite the point, the tear guide strips, the tear guide strips extending substantially along the lateral edges of the region that is to form the base as far as the region that is to form the heel portion, the tear guide strips comprising the first ends which extend into a flap that is to prolong the heel portion, and the first sheet is made of plastics material, and the first ends of the tear guide strips are spaced laterally from one another and delimit between them, in the flap, the pull tab for inducing tears in the packaging.

20. The packaging according to claim 12, wherein the tear guide strips extend along the lateral edges of the heel portion.

* * * * *